United States Patent [19]

Butterfield

[11] Patent Number: 4,718,213

[45] Date of Patent: Jan. 12, 1988

[54] DECORATIVE BEAM ASSEMBLY

[76] Inventor: Frank M. Butterfield, 4181 Valley Trail Dr., Atlanta, Ga. 30339

[21] Appl. No.: 9,150

[22] Filed: Jan. 30, 1987

[51] Int. Cl.[4] ..... E04C 3/36

[52] U.S. Cl. ..... 52/731; 52/313; 52/DIG. 8

[58] Field of Search ..... 52/731, 726, 313, DIG. 8

[56] References Cited

U.S. PATENT DOCUMENTS 3,277,624 10/1966 Cornell ..... 52/DIG. 8 X 3,890,415 6/1975 Hull ..... 52/DIG. 8 X 4,050,212 9/1977 Gantke et al. ..... 52/731

4,272,073 6/1981 Grasser et al. ..... 52/731 X

*Primary Examiner*—J. Karl Bell

*Attorney, Agent, or Firm*—Needle & Rosenberg

[57] ABSTRACT

A decorative beam assembly comprising a beam support bracket which is attached to a ceiling or wall and a hollow plastic channel shaped decorative beam, which snap-fittinglyengages the bracket by means of inwardly extending arms on the beam contacting flange surfaces on the bracket. The flexibility of the beam allows for easy installation, as well as removal and subsequent replacement, of the beam.

3 Claims, 5 Drawing Figures

DECORATIVE BEAM ASSEMBLY

BACKGROUND OF THE INVENTION

This invention relates to an interchangeable, decorative beam assembly and particularly to hollow decorative beams to and from ceilings and walls by means of interlocking brackets and generally U-shaped beams.

Traditionally, beams have been used in structures as supporting means for ceilings and walls. Over time, the presence of beams in structures has become an aesthetic consideration as well as a functional one. There is currently a demand for the decorative look of real wood beams. Because aesthetics are subject to human whim, however, an even greater need is present for a hollow, decorative imitation beam that can easily and inexpensively be replaced as a decorator desires.

Generally, beams have been made of wood. While meeting aesthetic needs, such beams are very heavy, difficult to attach, and are often prohibitively expensive. Any altering of the beams from one style to another requires refinishing, reconstruction or even replacement. Furthermore, as more and more structures are prefabricated and are made with lighter and therefore weaker ceilings and walls, heavy real wood beams become impractical. The fact that many homeowners can be described as "do it yourselfers," either through desire or economic necessity, illustrates the need for a quick, simple, yet aesthetically satisfactory attachment and detachment beam system, particularly for use in mobile and modular homes.

While there have been other attempts at providing decorative beams in the past, none have provided the ease of attachment and interchangeability of the present invention. U.S. Pat. No. 3,387,872 to Lovullo et al. describes a ceiling beam attachment clip wherein a metal bracket containing a series of protruding tabs is used to hold the edge of a folded beam into position. One attaching a beam to a ceiling using this bracket must fold the beam into the desired shape around the bracket while fitting the beam permanently into the tabs.

German Pat. No. 2,854,449 discloses a U-shaped simulated wooden beam that has resilient clips on its inner sides which fit over the edges of an inverted U-shaped channel that is secured to the ceiling.

SUMMARY OF THE INVENTION

The disadvantages of the prior art are overcome by the present invention which provides for the quick and simple attachment and detachment of lightweight decorator beams to ceilings and other surfaces so as to allow installation of the beams at a minimum of expense and effort.

The system comprises a flat support bracket with extending flanges running along each of its two sides. The bracket is secured to the ceiling or wall so that the flanges extend in outward direction. A hollow decorator beam, being made of a material allowing for flexibility and having inwardly directed attaching arms running along each of its inner edges, is attached to the support bracket by simply snapping the attaching arms over the extending flanges of the bracket.

The beam may be snapped off the bracket without damage to either, leaving the bracket which may be used to support a beam of different style, color or design. Further, since the beam is not permanently affixed to the bracket, the original beams may be stored and reused in the future as one wishes.

DETAILED DESCRIPTION OF THE INVENTION

The decorative beam assembly of the present invention for attaching and detaching decorative beams to and from ceilings and walls is described with reference to the FIGURES of the drawings. The numeral 10 denotes generally the invention comprising a support bracket 12 and a beam 14.

The support bracket 12 is constructed of a fairly rigid plastic material generally rectangular in configuration and is of any convenient length.

Figure 4:
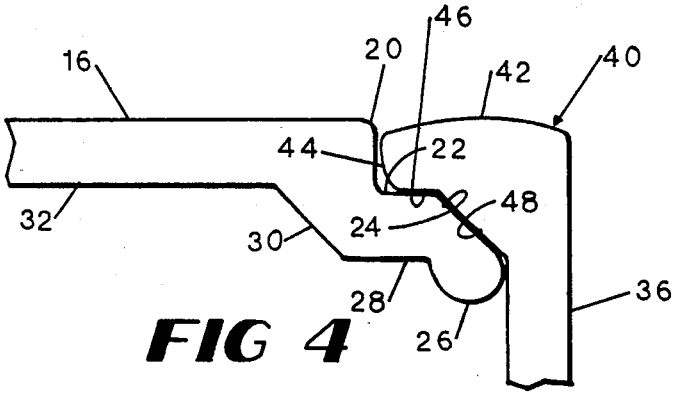
FIG. 4 is a detail of the present invention within arrow 4 in FIG. 3.

The bracket 12 has a flat ceiling engaging surface 16 with downwardly directed flange members 18 along its sides. As seen most clearly in FIG. 4, the flange member 18 comprises a vertical wall 20 at the termination of engaging surface 16, a horizontal portion 22 and an outwardly extending edge 24 which ends in a curved bulbous portion 26. Horizontal surface 28 joins portion 26 to upwardly angled surface 30 which is parallel to edge 24. The flat underside 32 of bracket 12 is parallel to surfaces 16 and 28. The bracket 12 is secured to the ceiling 34 along surface 16 by any conventional means, such as screws or nails (not shown).

The beam 14 is generally channel or flattened U-shape in cross-section with spaced parallel upstanding sides 36 which are joined at their bottom ends by bottom 38. The length of beam 14 will be substantially the same as the length of a bracket 12.

Referring again to FIG. 4, the tops of sides 36 terminate in inwardly directed arms 40 comprising upper surface 42 which is sloped and inclined slightly downward toward arcuate or rounded wall 44 that has a height slightly less than wall 20, bottom edge 46 which has a width that is slightly less than horizontal portion 22 and inner edge 48 that is parallel in slope to edge 24. As can be seen, the surfaces of wall 44, edge 46 and edge 48 are complimentary to wall 20, portion 22 and edge 24, respectively. The transverse distance between walls 44 is less than the width of bracket 12.

Figure 1:
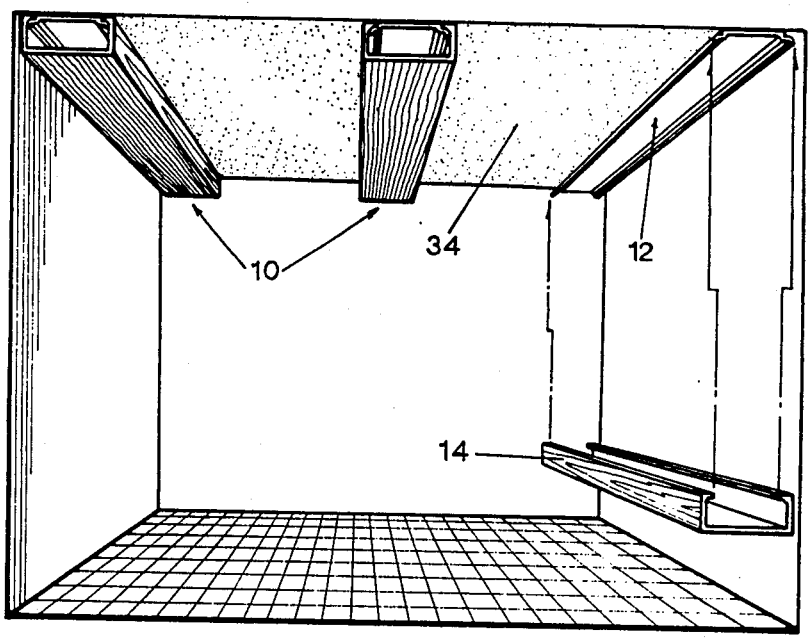
FIG. 1 is a perspective view of the decorative beams of the present invention as installed with one beam exploded for clarity.
Figure 2:
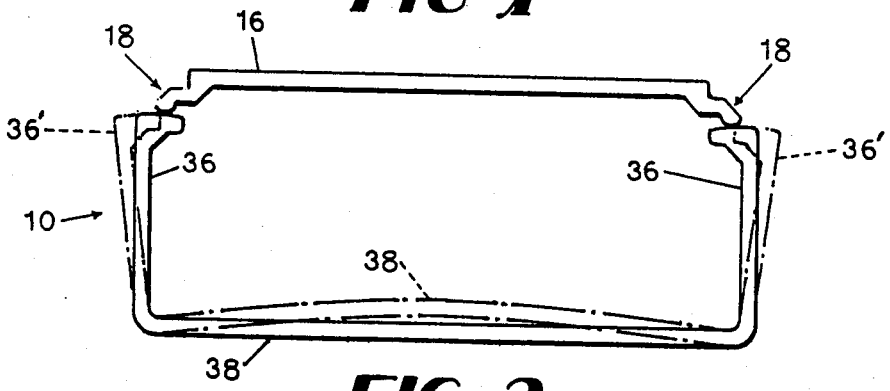
FIG. 2 is a vertical cross-section of the beam of the present invention prior to installation of the beam onto the support bracket with phantom lines indicating the shape of the beam just prior to engaging the bracket.

As seen in FIG. 2, the distance between sides 36 is such that the upper surface 42 of arms 40 engages bulbous portion 26 of flange members 18 before the beam 14 is detachably secured onto the bracket 12.

In operation, the bracket 12 is secured to the ceiling as described above in a position where it is desired for the beam 14 to eventually be. The beam 14 is grasped so that the upper surface 42 of arms 40 engage the respective curved portions 26 of the bracket 12. As seen in FIG. 2, further upward pressure on the beam 14 causes the sides 36 of the beam 14 to bend outwardly to portion 36′ with bottom 38 bowing upwardly to position 38′, allowing upper surface 42 to ride along curved portion 26, with surface 44 of the arms 40 sliding upwardly upon edge 24 until edge 46 contacts horizontal portion 22 and wall 44 abuts wall 20. Thus, the beam 14 is easily and simply snap-fitted into engagement with the bracket 12, with the weight of the beam 14 being evenly dispersed along the length of bracket 12, when the surface 42 is substantially in alignment with engaging surface 16.

Figure 3:
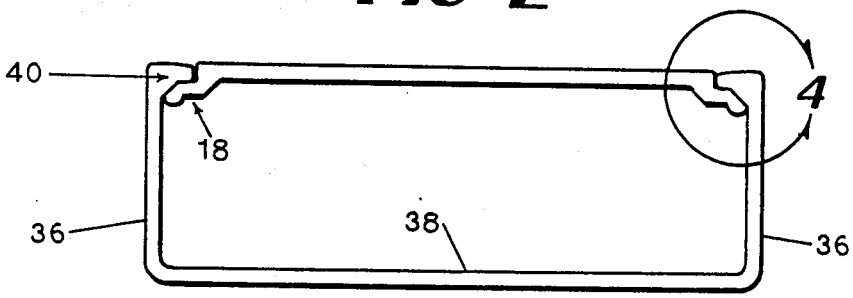
FIG. 3 is a vertical cross-section of the beam as installed on the bracket.

The beam 14 is made of a plastic material which allows sufficient flexibility (at least in sides 36) so that the beam 14 may be deformed slightly, as in FIG. 2, to allow the side 36 to spread slightly so that arms 40 can ride over and seat onto flanges 18 of the bracket. As seen in FIG. 3, the bracket 12 and beam 14 combination is essentially rectangular in cross-section. The beams 14 may have an embossed outer surface to simulate wood or they may have a wooden veneer applied thereto. Further, the plastic composition of the beams 14 can be colored to simulate any popular wood materials.

Figure 5:
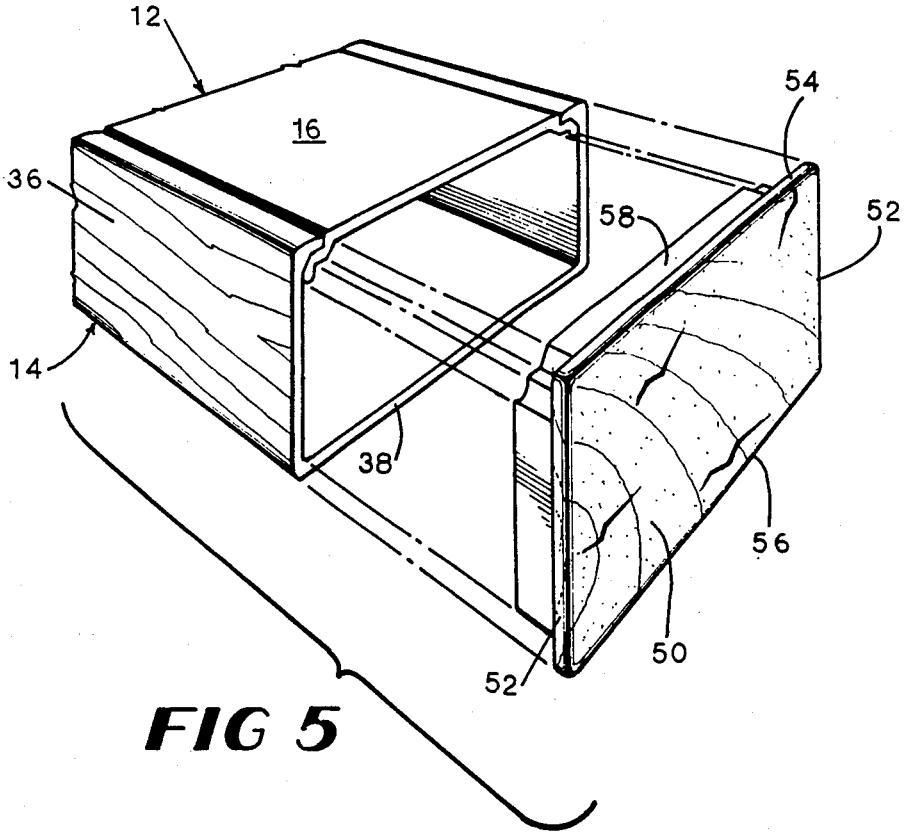
FIG. 5 is a partial exploded perspective view showing an optional end cap for the beam.

Referring to FIG. 5, an optional cap 50 can be inserted into the exposed, open ends of the assembly 10 to provide a finished, solitary, outward appearance to the invention. Sides 52, tops 54 and bottom 56 of the cap 50 are in alignment with sides 36, surface 16 and base 38, respectively, to give the beam 14 an integral appearance with the cap 50 in place. The cap 50 includes element 58 on its inner surface that is complimentary in shape to the inner opening formed by the beam 14 on bracket 12.

What is claimed is:

1. A decorative beam assembly for attachment to a ceiling, comprising an elongated support bracket having a flat ceiling attaching surface, means for securing said flat surface to said ceiling, flange members extending outwardly and downwardly from each side of said attaching surface, with said flange members having contoured upper surfaces, a hollow channel-shaped beam being of a length at least equal to said bracket and having a bottom and flexible, spaced, parallel side walls extending upwardly from said bottom, said side walls terminating in inwardly directed arms having bottom surfaces which are complimentary contoured to said upper surface of said flange members, said arms being detachably secured onto said flange members of said support bracket when said support bracket is secured to said ceiling by separating said parallel sidewalls to a width greater than the width of said attaching surface and urging the attaching arms over said flange members using upward pressure so that said attaching arms snap-fittingly engage said flange members.

2. A decorative beam assembly as claimed in claim 1, comprising a cap which engages at least one end of said beam construction so as to provide a finished appearance to said construction.

3. A decorative beam assembly as claimed in claim 1, wherein said arms have top surfaces which are arcuate so as to ride on a portion of the bottom of said flange members when upward pressure is applied to said beam to secure said beam onto said bracket.

* * * * *